United States Patent [19]

Ando et al.

[11] Patent Number: 4,970,975

[45] Date of Patent: Nov. 20, 1990

[54] ROTARY LOOPTAKER

[75] Inventors: Ryuzo Ando, Aichi; Kousaku Toratani; Masamichi Sato, both of Nagoya; Nobuyoshi Nakashima, Nagoya; Yosiyasu Hanya, Nagoya, all of Japan

[73] Assignee: Brother Kogyo Kabushiki Kaisha, Nagoya, Japan

[21] Appl. No.: 356,345

[22] Filed: May 24, 1989

[30] Foreign Application Priority Data

Jul. 20, 1988 [JP] Japan ..... 63-96867[U]

[51] Int. Cl.[5] ..... D05B 57/00; D05B 57/14; D05B 57/16

[52] U.S. Cl. ..... 112/228; 112/181; 112/184; 112/231

[58] Field of Search ..... 112/80.5, 80.52, 32, 112/181, 182, 188, 191, 196, 228, 229, 231, 232, 233, 302

[56] References Cited

U.S. PATENT DOCUMENTS

| | | | |
|---|---|---|---|
| 2,108,412 | 2/1938 | Sauer | 112/228 |
| 3,343,510 | 9/1967 | Attwood | 112/181 X |
| 3,347,193 | 10/1967 | Perri | 112/228 |
| 3,382,826 | 5/1968 | Johnson | 112/184 |
| 3,390,653 | 7/1968 | Ketterer | 112/184 X |
| 4,074,643 | 2/1978 | Ketterer | 112/181 |
| 4,355,590 | 10/1982 | Ketterer | 112/184 |
| 4,676,178 | 7/1987 | Hirose | 112/231 |
| 4,700,643 | 10/1987 | Hirose | 112/231 |

FOREIGN PATENT DOCUMENTS 1116962 11/1959 Fed. Rep. of Germany .

*Primary Examiner*—Werner H. Schroeder
*Assistant Examiner*—Ismael Izaguirre
*Attorney, Agent, or Firm*—Oliff & Berridge

[57] ABSTRACT

A rotary looptaker includes a looptaker body rotatable about a vertical axis and a bobbin case restrained from rotary motion with the looptaker body. A plurality of annular protrusions are provided on a flange of the bobbin case so as to extend in a circumferential direction of the bobbin case and are in engagement with a flat surface formed on a raceway of the looptaker body. When the looptaker body is rotated, the bobbin case slides relative to the looptaker body through a very small contact area between the annular protrusions and the flat surface, thus reducing sliding friction between the looptaker body and the bobbin case. Accordingly, noise and vibration are decreased when a rotation restraining projection of the bobbin case contacts a restraint element secured to a machine frame.

10 Claims, 3 Drawing Sheets

ROTARY LOOPTAKER

FIELD OF THE INVENTION

The present invention relates to a rotary looptaker having a looptaker body rotatable about a substantially vertical axis and a bobbin case restrained from rotary motion with the looptaker body, and more particularly to a construction for reducing sliding friction between the looptaker body and the bobbin case.

BACKGROUND OF THE INVENTION

A conventional rotary looptaker of the type described above is disclosed in Japanese Utility Model No. 57-13024. A looptaker body is provided with a raceway having an upper flat surface. A bobbin case has a flange with a flat lower surface which is engageable with the upper surface. When a sewing machine is driven, the looptaker body is rotated relative to the bobbin case with sliding contact through both flat surfaces.

In such a conventional looptaker, however, the looptaker body and the bobbin case are in engagement with each other through the relatively large contact area between the flat surfaces, so that sliding friction between the flat surfaces is large and a large rotative force is imparted to the bobbin case owing to the large sliding friction when the looptaker body is rotated relative to the bobbin case. Consequently, excessive noise and vibration are produced because of that friction when the bobbin case is restrained from rotary motion in the presence of the large rotative force. The noise and vibration are generated by the contact of a restraining projection on the bobbin case with a restraint element secured to the machine frame.

SUMMARY OF THE INVENTION

It is an object of the present invention to provide a structurally non-complex rotary looptaker capable of reducing noise and vibration.

To accomplish the above object, in a rotary looptaker of the type having a looptaker body rotatable about a substantially vertical axis and having an annular raceway including a substantially horizontal bearing surface, and a bobbin case restrained from rotary motion with the looptaker body and having a flange including a surface engageable with the substantially horizontal bearing surface of the annular raceway, a rotary looptaker according to the present invention comprises means on one of the bearing surface of the annular raceway and the surface of the flange to reduce sliding friction between the looptaker body and the bobbin case; the means defining an engageable region of contact, between the annular raceway and the flange, which is substantially less than the area of the confronting surfaces of the annular raceway and the flange.

In the rotary looptaker constructed as described above, the means on one surface is in engagement with the other surface through a very small contact area and the looptaker body can freely slide relative to the bobbin case with small sliding friction. As a result, the rotative force imparted to the bobbin case can be reduced, thereby reducing noise and vibration between the restraining projection on the bobbin case and the restraint element secured to the machine frame when the bobbin case is restrained from rotary motion with the looptaker body.

BRIEF DESCRIPTION OF THE DRAWINGS

The above and other objects, features and advantages of the present invention will become more apparent from reading the following description of the preferred embodiment taken in connection with the accompanying drawings in which.

DESCRIPTION OF THE PREFERRED EMBODIMENT

Referring to the accompanying drawings, an embodiment of the rotary looptaker according to the present invention will now be explained.

Figure 1:
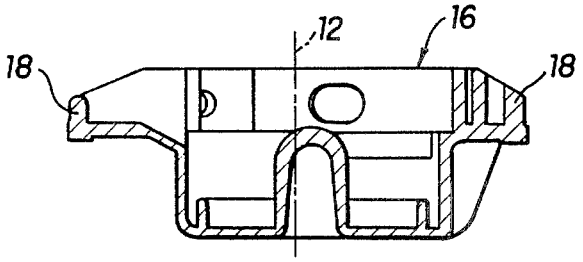
FIGS. 1 and 1A are disassembled cross-sectional view of an embodiment of a rotary looptaker according to the present invention.
Figure 1A:
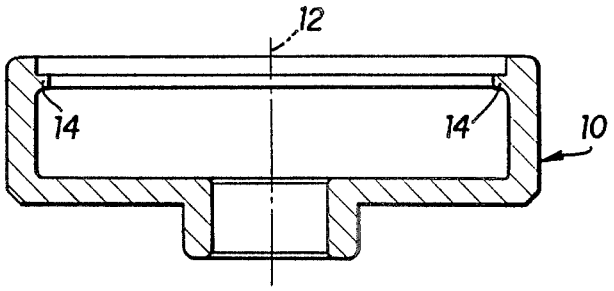

As shown in FIG. 1, a looptaker body 10 is constructed so as to be rotated about a vertical axis 12 by a known driving mechanism. A raceway 14 is provided on an inner side wall of the looptaker body 10 and comprises an annular rib which projects toward the vertical axis 12 and extends in a circumferential direction of the looptaker body 10. FIG. 1A shows a bobbin case 16 which is adapted to be accommodated within the looptaker body 10 and is provided at its outermost edge with a flange 18 engageable with the raceway 14.

Figure 2:
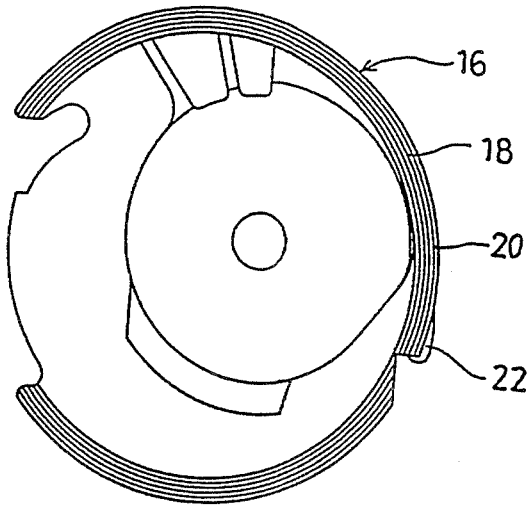
FIG. 2 is a bottom plan view of a bobbin case of the looptaker shown in FIG. 1.
Figure 3:
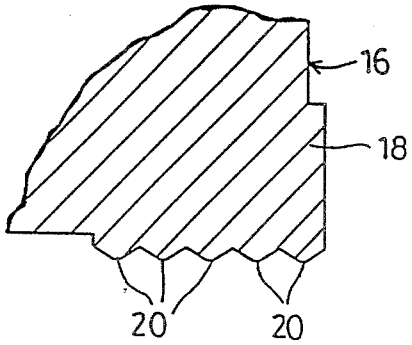
FIG. 3 is an enlarged cross-sectional view of a flange of the bobbin case.

Five annular protrusions 20 are provided on a lower surface of the flange 18 so as to extend in a circumferential direction of the bobbin case 16 as shown in FIGS. 2 and 3, and defines an engageable region of contact, between the raceway 14 and the flange 18, which is substantially less than the area of the confronting surfaces of the raceway 14 and the flange 18. These protrusions 20 are molded integrally with the bobbin case for easy manufacture. The bobbin case 16 is positioned by means of engagement of these protrusions 20 with the flat upper surface of the raceway 14, and further is positioned in a horizontal direction through engagement of an outer side wall of the flange 18 and an inner side wall of the looptaker body 10.

In addition, a rotation restraining projection 22 is integrally formed on an outer side wall of the bobbin case 16, and is disposed to engage with a known restraint element secured to a frame of a sewing machine. When the looptaker body 10 is rotated, the bobbin case 16 is restrained from rotary motion with the looptaker body 10 by means of engagement of the rotation restraining projection 22 with the restraint element.

The operation of the rotary looptaker constructed as described above will now be explained.

When the looptaker body 10 is rotated by the driving mechanism, the bobbin case 16 is restrained from rotary motion with the looptaker body 10 by engagement of the rotation restraining projection 22 and the foregoing restraint element. The protrusions 20 on the lower surface of the flange 18 slide on the flat upper surface of the raceway 14 during rotation of the looptaker body 10. Since there is a very small contact area between the edges of the protrusions 20 and the flat upper surface of the raceway 14 and further the protrusions 20 are successively formed so as to extend in a rotational direction of the looptaker body 10, the sliding friction between the looptaker body 10 and the bobbin case 16 is substantially decreased and a very small rotative force is imparted to the bobbin case 16 from the looptaker body 10. Accordingly, noise and vibration, between the restraining projection 22 and the restraint element, due to the rotative force are decreased when the rotation restraining projection 22 engages with the restraint element secured to the machine frame.

Figure 4:
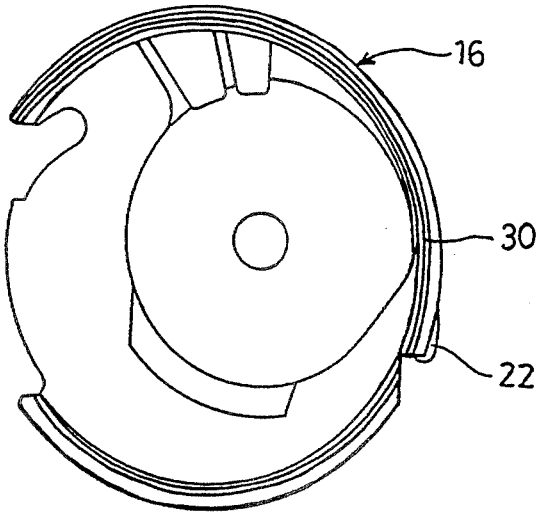
FIG. 4 is a bottom plan view of a bobbin case of another embodiment of the present invention.

Although the protrusions 20 are formed on the lower surface of the flange 18 in this embodiment, plural protrusions may be formed on the upper surface of the raceway 14. In addition, a plurality of annular protrusions 20 are formed in the circumference of the bobbin case 16 in this embodiment, but alternatively a single spiral protrusion 30 may be formed so as to extend in the circumferential direction of the bobbin case as shown in FIG. 4.

It should be understood that the present invention is not limited to the above description, but is subject to modifications, alterations and equivalent arrangements within the scope of the appended claims. Thus, while only certain embodiments of the invention have been specifically described herein, it will be apparent from the above teachings that numerous modifications may be made thereto without departing from the spirit and scope of the invention.

What is claimed is:

1. A rotary looptaker having a looptaker body rotatable about a substantially vertical axis and having an annular raceway, and a bobbin case accommodated within said looptaker body and having a flange including a surface engageable with said annular raceway, said bobbin case being restrained from rotary motion with said looptaker body, said rotary looptaker comprising:

a substantially horizontal and flat bearing surface on said annular raceway; and protrusion means on said surface of said flange and engageable with said bearing surface of said annular raceway to reduce sliding friction between said looptaker body and said bobbin case.

2. A rotary looptaker according to claim 1, wherein said protrusion means comprises a plurality of protrusions each circumferentially extending on said surface of said flange.

3. A rotary looptaker according to claim 1, wherein said protrusion means comprises a plurality of annular protrusions.

4. A rotary looptaker according to claim 1, wherein said protrusion means comprises a spiral protrusion.

5. A rotary looptaker according to claim 1, wherein said protrusion means comprises a single spiral protrusion.

6. A rotary looptaker having a looptaker body rotatable about a substantially vertical axis and having an annular raceway, and a bobbin case accommodated within said looptaker body and having a flange including a surface engageable with said annular raceway, said bobbin case being restrained from rotary motion with said looptaker body, said rotary looptaker comprising:

a substantially horizontal and flat bearing surface on said annular raceway; and protrusion means circumferentially extending on said surface of said flange and engageable with said bearing surface of said annular raceway to reduce sliding friction between said looptaker body and said bobbin case.

7. A rotary looptaker according to claim 6, wherein said protrusion means comprises a plurality of annular protrusions.

8. A rotary looptaker according to claim 6, wherein said protrusion means comprises a spiral protrusion.

9. A rotary looptaker according to claim 6, wherein said protrusion means comprises a single spiral protrusion.

10. A rotary looptaker having a looptaker body rotatable about a substantially vertical axis and having an annular rib, and a bobbin case including a flange having a lower surface adapted to be mounted on said rib and restrained from rotary motion with said looptaker body, said rotary looptaker comprising:

a plurality of annular protrusions on the lower surface of said flange; and said rib having a flat upper surface engageable with said plurality of annular protrusions whereby circumferential sliding friction between said looptaker body and said bobbin case is reduced.

* * * * *